US005195582A

United States Patent [19]

Haase

[11] Patent Number: 5,195,582

[45] Date of Patent: Mar. 23, 1993

[54] SEALING JUNCTION FOR A HEAT EXCHANGER

[75] Inventor: Martin W. Haase, Lockport, N.Y.

[73] Assignee: General Motors Corporation, Detroit, Mich.

[21] Appl. No.: 933,273

[22] Filed: Aug. 21, 1992

[51] Int. Cl.[5] ..... F28F 9/04; B23P 11/00

[52] U.S. Cl. ..... 165/173; 165/149; 29/890.03; 29/890.052; 29/505

[58] Field of Search ..... 165/173, 153, 149; 29/890.03, 890.052, 505, 508

[56] References Cited

U.S. PATENT DOCUMENTS

| | | | |
|---|---|---|---|
| 3,861,339 | 1/1975 | Aida et al. | 29/505 |
| 3,862,490 | 1/1975 | Tsuneishi et al. | 29/505 |
| 4,351,390 | 9/1982 | Argyle et al. | 165/149 |
| 4,401,157 | 8/1983 | Cadars | 165/173 |
| 4,455,728 | 6/1984 | Hesse | 29/890.03 |
| 4,485,867 | 12/1984 | Melnyk et al. | 165/173 |
| 4,544,029 | 10/1985 | Cadars | 165/173 |
| 4,738,308 | 4/1988 | Moranne | 165/173 |
| 4,997,035 | 3/1991 | Beatenbough et al. | 165/173 |

FOREIGN PATENT DOCUMENTS

| | | | |
|---|---|---|---|
| 3544588 | 6/1987 | Fed. Rep. of Germany | 165/173 |
| 1039911 | 10/1953 | France | 29/890.03 |
| 2270471 | 12/1975 | France | 29/890.03 |
| 7416284 | 12/1975 | France . | |
| 181593 | 9/1985 | Japan | 165/173 |
| 2070223 | 9/1981 | United Kingdom . | |
| 2108648 | 5/1983 | United Kingdom | 165/173 |

*Primary Examiner*—John Rivell
*Assistant Examiner*—L. R. Leo
*Attorney, Agent, or Firm*—Patrick M. Griffin

[57] ABSTRACT

A sealing junction (47) for a heat exchanger (40) includes a rounded foot (50) at the lower end of a tank (46) positioned in a channel (52) a the periphery of a header end plate section (54). The channel includes a rounded flange (56) that has rounded tabs (48) smoothly and continuously extending therefrom that clinch the foot (50).

8 Claims, 1 Drawing Sheet

SEALING JUNCTION FOR A HEAT EXCHANGER

TECHNICAL FIELD

The field of this invention relates to heat exchangers and more particularly to sealing junctions in a heat exchanger.

BACKGROUND OF THE DISCLOSURE

Heat exchangers are used in the vast majority of motor vehicles that are powered by an internal combustion engine. Heat exchangers may be used for engine cooling and for internal climate control. Most heat exchangers include a header and a tank at each end of the header. It has become common practice to manufacture the tank from a plastic material and the header from a heat conductive metal material such as aluminum. The plastic tank is mechanically joined to the header. It is vital that the junction between the tank and header be leak-free and durable in spite of the corrosive fluid that flows through the heat exchanger.

With reference to FIG. 1, a junction 11 of heat exchanger 10 known in the prior art is now illustrated. It is now common practice to provide a channel 12 in the header 14 and a foot 16 at the lower end of the tank 18 of heat exchanger 10. The tank foot 16 is sized to be received in the channel with a sealing gasket 20 interposed between the tank and header. The channel 12 has an outer flange 22 with a plurality of tabs 24 that are clinched about the foot to retain the foot within the channel.

Several disadvantages exist with the present tank and header junction 11 constructions. Firstly, the tab 24 is bent from the outer flange 22 to bend about a corner 26 of the foot 16. The clinching operation of the tabs uses the corner 26 of foot 16 as a fulcrum resulting in stress exerted on the plastic tank foot 16. Excess stress can result in cracks in the foot ruining the integrity of the tank.

Furthermore, the clinch process is sensitive to the tab height variations due to manufacturing tolerances. The applied clinching force is applied as close to the top 25 of the header tabs 24 as possible to provide maximum mechanical advantage. The applied clinching force may then, depending on the height of the tabs, exert different levels of stress on the foot corner 26 that is used as a fulcrum. The tab height must be limited to decrease the stress exerted on the fulcrum point 26. Due to manufacturing tolerances, one tab may be shorter than others. Because of the short height of the tabs, the applied force to effectively bend the shorter tab must be significantly higher than for the other tabs due to the short tab heights. Consequently, the force used to bend all the tabs is the force needed to bend the shortest tab is undesirable in that it may stress the foot of the tank.

In addition, the tank foot is provided with a chamfer 28 along its side wall 30 for ease of installation of the tank into the header channel. The chamfer provides a pocket 32 into which the sealing gasket 20 may be squeezed and displaced around a bottom corner 34 of the foot during the clinching operation. The resulting high compression of the sealing gasket may damage the gasket or render an inadequate seal.

The above problems are cumulative. Consequently, most leakage and warranty problems in heat exchangers of the above described construction occur in the junction between the tank and header.

What is needed is a junction construction for a heat exchanger that is easily assembled with a minimum amount of stress exerted on the tank foot during assembly and that eliminates the above described problems.

What is also needed is a method for assembling a heat exchanger that provides for a reliable and securely sealed junction.

SUMMARY OF THE DISCLOSURE

In accordance with one aspect of the invention, a heat exchanger has a header connected to a tank with a foot. The foot has a outer peripheral surface with a continuous and smooth contour from end to end and having no corners. The header has a channel with an outer flange that has a first continuous and smooth curve conforming to the contour of the foot to clinch about said foot and retain said foot within said channel. Preferably, a seal is interposed between the foot and channel. This seal may be an elastomeric gasket that is under compression when the tank foot is assembled within the channel.

Preferably, the outer flange has an upper portion that includes a plurality of spaced tabs that are continuously and smoothly curved along their height. The tabs are clinched about the foot. In one embodiment, the tabs are, formed to be preformed into a second continuous and smooth curve before the tank foot is installed onto the header. The tabs are constructed to be bent upon a clinching force to the first continuous and smooth curve independently of whether the foot is within the channel.

According to another aspect of the invention, a method for manufacturing a heat exchanger having a tank and header mechanically joined together is provided. The method includes providing a header having a flange about its channel that is continuously and smoothly curved. The tank has a foot with an outer peripheral surface that has a continuous and smooth contour from end to end and having no corners. A gasket is positioned within the channel. The foot of the tank is placed within said channel and a clinching force is applied to the flange to clinch the flange about the foot and being continuously and smoothly contoured about said foot. The clinching of the flange about the foot places the gasket under compression to provide a seal between the tank and header.

Preferably, the flange includes a plurality of preformed tabs that smoothly and continuously extend from the flange. The tabs are bent upon an inwardly directed force to clinch the foot in position. The bent tabs remain smoothly and continuously extending from the lower section of the flange in a smoothly formed arc.

BRIEF DESCRIPTION OF THE DRAWINGS

Reference now is made to the accompanying drawings in which.

DETAILED DESCRIPTION OF THE PREFERRED EMBODIMENT

Figure 1:
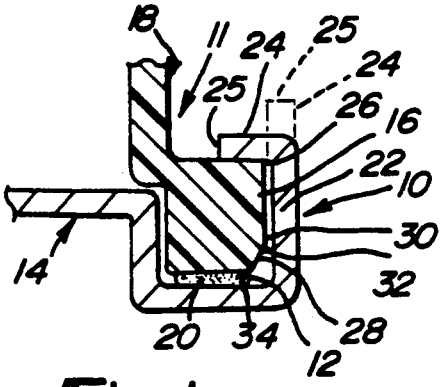
Fig-1 PRIOR ART
FIG. 1 is a segmented view of a junction between a tank and header as known in the prior art.
Figure 2:
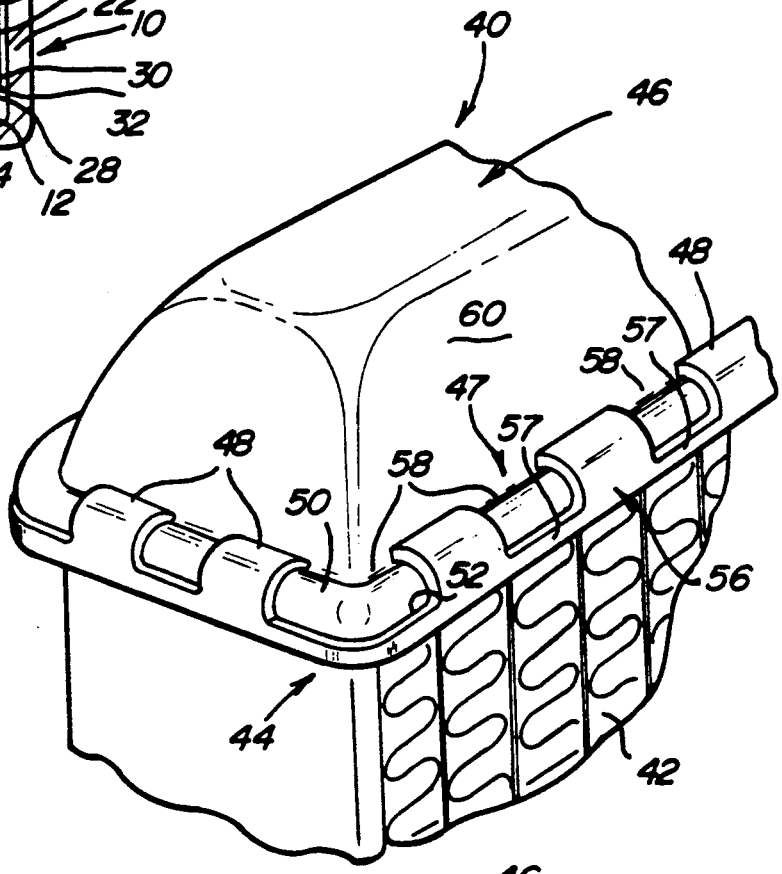
FIG. 2 is a fragmentary perspective view of a heat exchanger in accordance with the invention.

Referring now to FIG. 2, a heat exchanger 40 has a radiator core 42 with a header 44 at one end that is joined to a tank 46 at junction 47. The header 44 at junction 47 has a plurality of tabs 48 that are clinched over a foot 50 of the tank which is seated in a channel 52 within header 44.

The junction 47 is described with reference to FIG. 4. The header 44 has an end plate section 54 with channel 52 formed about its periphery. The channel 52 is formed by a rounded flange 56 that extends from the end plate section 54 and has a plurality of spaced tabs 48 with notches 58 therebetween. The tabs 48 follow the same contour as the rest of flange 56 i.e., the tabs 48 are a smooth and continuous extension from the lower portion 57 of flange 56.

The tank 46 has a substantially vertical wall 60 with the tank foot 50 extending outwardly along a bottom edge thereof. The foot 50 has an inner heel section 62 and an outer periphery 64 that has a rounded convex contour continuously and smoothly extending from the heel section to its other surface end connected to the outer surface 66 of the vertical wall 60. The rounded contoured periphery 64 is free of corners. The foot 50 is sized to fit within the channel 52. The tabs 48 are clinched about the periphery 64 to retain the foot 50 within the channel.

An annular gasket 70, for example an O-ring, is compressed between the foot 50 and channel flange 56 to form a leak-free junction. The gasket 70 may be made from an elastomeric material. Other types of gaskets may also be used that have different cross sectional shapes.

Figure 3:
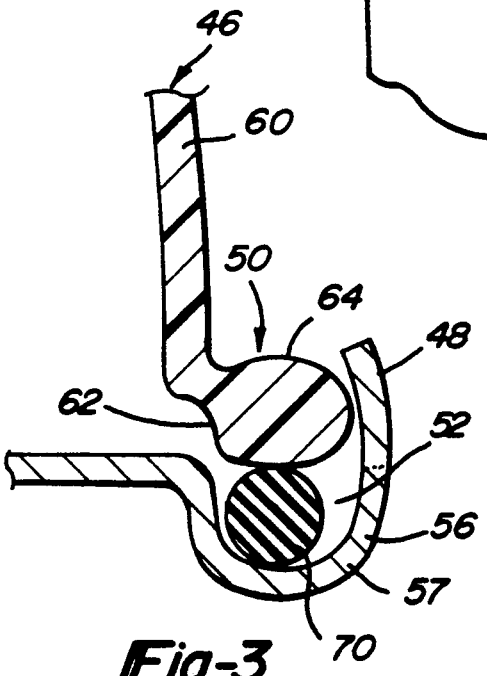
FIG. 3 is a fragmentary and partially segmented perspective view of a partially assembled junction between the tank and header in the heat exchanger shown in FIG. 2.

The assembly of the junction 47 is now explained with reference to FIGS. 3 and 4. The unassembled heat exchanger 40 is shown in FIG. 3 with the tabs 48 preformed in the shown position. The tabs 48 are curved upwardly and slightly inwardly. The curve is smooth and continuous from the lower section 57 of flange 56. The open channel 52 is sized to receive the gasket 70 and the foot 50. The tank 46 is pressed downward upon the gasket 70 to its assembled position. While the tank is retained in the downward assembled position, the tabs 48 are pressed inwardly such that they become bent over the contoured periphery 64 of the foot 50 retaining the smooth continuity of the contour extending from the lower flange section 57.

Figure 4:
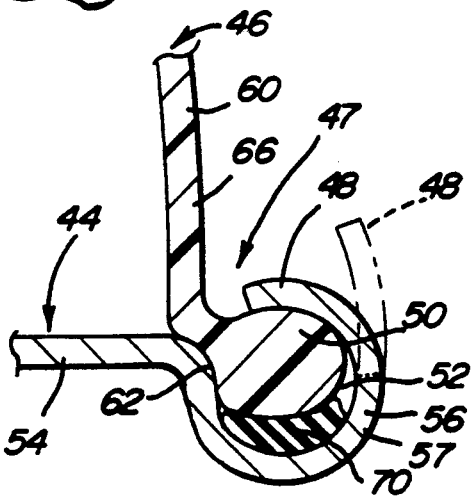
FIG. 4 is a cross-sectional view taken along line 4—4 as shown in FIG. 2.

Ideally, the tabs 48 are constructed to be smoothly bent by a bending side force into the shape as shown in FIG. 4 independent of whether the foot 50 is in the channel 52 or not, i.e., the tabs are bent into the shape shown in FIG. 4 by a bending side force independently, i.e., without the use of the foot 50 as a fulcrum. In this fashion, the foot 50 does not receive any detrimental stresses exerted thereon during assembly of the heat exchanger. When all the tabs 48 are bent to the position shown in FIG. 4, the force is sufficient to retain the tank foot in position against the biasing force exerted by the gasket 70 and against any other forces normally encountered to retain a structural assembly.

In this fashion, a heat exchanger junction 47 is formed with integrity against leakage and damage to the foot 50 during assembly. The gasket 70 is correctly positioned at the bottom of the channel 52 and cannot be mispositioned by a corner of a foot. The tabs 48 by being continuous and smooth extensions of the lower section 57 of the flange 56 may be significantly longer than tabs found in conventional squared off channel constructions.

The increased length of the tabs renders several advantages. Firstly, the length renders an increased mechanical advantage during the clinching operation. The increased mechanical advantage results in less magnitude of force needed to bend the tabs. Furthermore, the increased length of the tabs also decreases the effect of lowering the point of applied force from the top of the tabs. In other words, if due to manufacturing tolerances, one tab is shorter than the others, the side force applied to the top of the shorter tab needs to be increased but the increase is significantly lower than the increase for conventional squared off short tabs. Therefore the needed force applied to all the tabs 48 to effectively clinch them over the foot 50 is significantly lower as compared to squared off tabs over a squared off foot. The resulting stress that the foot 50 sees is thus greatly reduced. It is foreseen that the tab height may be increased by approximately one-half of the tank foot height.

Secondly, the elimination of sharp corners of the tank foot greatly reduces the likelihood of pinching, stretching or mislocation of the gasket 70 within channel 52.

Thirdly, the rounded tank foot is more suitable for existing injection molding processes used to manufacture tanks resulting in a more structurally sound tank foot.

Variations and modifications are possible without departing from the scope and spirit of the present invention as defined by the appended claims.

I claim:

1. A heat exchanger characterized by:

a tank being sealingly secured to a header;

said tank having an outwardly extending foot section with an inner heel section displaced outwardly from an upwardly extending wall of said tank;

said foot section being outwardly displaced from said heel section and having a convexly contoured outer perimeter surface from said heel section;

said outer perimeter surface being smoothly contoured from said heel section to another end connected to said upwardly extending wall and having no corners therebetween; said header having a channel configured to receive the tank foot section and having an outer flange for gripping the foot section, said outer flange being continuously and smoothly curved about said tank foot section outer perimeter surface; and an annular gasket being mounted in said channel and being compressed between the foot section and said header.

2. A heat exchanger as defined in claim 1 further characterized by:

said outer flange including a plurality of spaced tabs continuously and smoothly curved along its length.

3. A heat exchanger as defined in claim 2 further characterized by:

said tabs being preformed along its length along a continuous and smooth curve before installation of said tank and clinching of said tabs about said tank foot section.

4. A method of forming a heat exchanger having a tank mechanically joined to a header, said method characterized by:

providing a header having a channel with an outer upright flange that is continuously and smoothly curved along its height;

forming a tank with a foot about its perimeter, said foot having a continuously and substantially rounded contour in cross section on its peripheral surface, said foot being sized to fit within said channel;

clinching said continuously curved flange about said foot to trap and retain said foot within said channel; and providing a seal between said tank foot and said header within said channel.

5. A method of forming a heat exchanger as defined in claim 4 further characterized by:

said flange being constructed such that when a clinching force is applied thereto, said flange is bent along a contour of said foot peripheral surface independent of the presence of said foot.

6. A method of forming a heat exchanger as defined in claim 4 further characterized by:

said flange includes a plurality of spaced tabs continuously and smoothly curved along their length.

7. A method of forming a heat exchanger as defined in claim 6 further characterized by:

said tabs being preformed along their length along a continuous curve before installation of said tank and said clinching of said tabs about said tank foot.

8. A method of forming a heat exchanger as defined in claim 7 further characterized by:

said tabs being constructed such that when a clinching force is applied thereto, said tabs are bent along a contour of said foot peripheral surface independent of the presence of said foot.

* * * * *